US011020839B2

(12) United States Patent
Akuretiya et al.

(10) Patent No.: US 11,020,839 B2
(45) Date of Patent: Jun. 1, 2021

(54) APPARATUS OF SUPPLYING SLURRY FOR PLANARIZATION PROCESS AND CHEMICAL-MECHANICAL-POLISHING SYSTEM INCLUDING THE SAME

(71) Applicant: Samsung Electronics Co., Ltd., Suwon-si (KR)

(72) Inventors: Achala Akuretiya, Austin, TX (US); Mehrdad Hosni, Austin, TX (US)

(73) Assignee: SAMSUNG ELECTRONICS CO., LTD.

( * ) Notice: Subject to any disclaimer, the term of this patent is extended or adjusted under 35 U.S.C. 154(b) by 471 days.

(21) Appl. No.: 16/105,904

(22) Filed: Aug. 20, 2018

(65) Prior Publication Data

US 2019/0381631 A1 Dec. 19, 2019

Related U.S. Application Data

(60) Provisional application No. 62/686,189, filed on Jun. 18, 2018.

(51) Int. Cl.
*B24B 57/02* (2006.01)

(52) U.S. Cl.
CPC ..... *B24B 57/02* (2013.01)

(58) Field of Classification Search
CPC ..... B24B 57/02; B24B 57/00; B24B 57/04; B24B 55/02; B01F 5/10
See application file for complete search history.

(56) References Cited

U.S. PATENT DOCUMENTS

| | | | | |
|---|---|---|---|---|
| 5,504,335 | A | 4/1996 | Maarschalkerweerd | |
| 6,228,255 | B1 | 5/2001 | Peterson et al. | |
| 8,297,830 | B2 | 10/2012 | Tseng et al. | |
| 8,517,802 | B2 * | 8/2013 | Tseng | B24B 57/02 451/60 |
| 8,992,287 | B2 * | 3/2015 | Wang | B24B 37/04 451/60 |
| 2006/0043029 | A1 * | 3/2006 | Chang | B01D 37/00 210/798 |
| 2007/0111639 | A1 * | 5/2007 | Moon | B24B 57/02 451/5 |
| 2008/0012157 | A1 * | 1/2008 | Kandiyeli | B24B 37/04 257/798 |

* cited by examiner

*Primary Examiner* — Dung Van Nguyen
(74) *Attorney, Agent, or Firm* — Renaissance IP Law Group LLP

(57) ABSTRACT

An apparatus of supplying slurry for a planarization process includes a housing having a first side and a second side and channels extending through the housing from the first side to the second side along a first direction. The channels include a first channel connecting a first inlet on the first side and a first outlet on the second side, a second channel connecting a second outlet on the first side and a second inlet on the second side, a third channel connecting a third inlet on the first side and a third outlet on the second side, and a fourth channel connecting a fourth outlet on the first side and a fourth inlet on the second side. An intermediate portion of the second channel crisscrosses an intermediate portion of the third channel along a second direction crossing the first direction.

17 Claims, 2 Drawing Sheets

APPARATUS OF SUPPLYING SLURRY FOR PLANARIZATION PROCESS AND CHEMICAL-MECHANICAL-POLISHING SYSTEM INCLUDING THE SAME

CROSS-REFERENCE TO RELATED APPLICATION

This application claims the priority of U.S. Provisional Application No. 62/686,189 filed on Jun. 18, 2018, the disclosure of which is incorporated herein by reference in its entirety.

TECHNICAL FIELD

The present inventive concept relates to an apparatus of supplying slurry for a planarization process and a chemical-mechanical-polishing system including the same.

DISCUSSION OF RELATED ART

Integrated circuit chips are formed by multiple layers on a semiconductor substrate. In stacking the multiple layers, each layer may be planarized for its subsequent stacking of another layer using a planarization process such as a chemical-mechanical-polishing (CMP) process.

CMP processes may be performed in CMP stations using slurry delivered from a slurry supply unit. The slurry may contain an abrasive such as colloidal silicon dioxide or alumina, deionized water, and chemical solvents or oxidants such as hydrogen peroxide, potassium or ammonium hydroxide. When a delivery path of the slurry from the slurry supply unit to the CMP stations has deadlegs of a stagnant flow, the slurry may accumulate and/or solidify in the deadlegs. This agglomeration may make maintaining proper slurry concentrations and quality difficult to achieve.

SUMMARY

According to an exemplary embodiment of the present inventive concept, an apparatus of supplying slurry for a planarization process includes a housing having a first side and a second side and a plurality of channels extending through the housing from the first side to the second side along a first direction. The channels include a first channel connecting a first inlet on the first side and a first outlet on the second side, a second channel connecting a second outlet on the first side and a second inlet on the second side, a third channel connecting a third inlet on the first side and a third outlet on the second side, and a fourth channel connecting a fourth outlet on the first side and a fourth inlet on the second side. An intermediate portion of the second channel crisscrosses an intermediate portion of the third channel along a second direction crossing the first direction.

According to an exemplary embodiment of the present inventive concept, an apparatus of supplying slurry for a planarization process includes a housing having a first side and a second side, a first channel connecting a first inlet on the first side and a first outlet on the second side, a second channel connecting a second outlet on the first side and a second inlet on the second side, a third channel connecting a third inlet on the first side and a third outlet on the second side, a fourth channel connecting a fourth outlet on the first side and a fourth inlet on the second side, a first branch line selectively connecting the first channel and the third channel using a first valve, and a second branch line selectively connecting the second channel and the fourth channel using a second valve. The second channel and the third channel extend in a first direction, crossing each other at a first cross-point and crossing each other back via a second cross-point. The first branch line and the second branch line each extends in a second direction crossing the first direction.

According to an exemplary embodiment of the present inventive concept, a chemical-mechanical polishing (CMP) system includes a plurality of slurry supply units, a redundancy box, at least two loops and a plurality of CMP stations. The slurry supply units include a first slurry supply unit and a second slurry supply unit. The redundancy box receives slurry from at least one of the first slurry supply unit and the second slurry supply unit. The two loops include an inner loop and an outer loop, each loop includes a supply line supplying the slurry from the redundancy box and a return line returning the slurry to the redundancy box. The CMP tools each receives the slurry from the supply line and performing a planarization process on a wafer using the slurry. The redundancy box includes a first channel connecting selectively the first slurry supply unit to the supply line of the inner loop, a second channel connecting selectively the return line of the inner loop to the first slurry supply unit, a third channel connecting selectively the second slurry supply unit to the supply line of the outer loop, a fourth channel connecting selectively the return line of the outer loop to the second slurry supply unit, a first branch line connecting selectively the first channel to an intermediate portion of the third channel, and a second branch line connecting selectively an intermediate portion of the second channel to the fourth channel. The intermediate portion of the second channel crisscrosses the intermediate portion of the third channel.

BRIEF DESCRIPTION OF DRAWINGS

These and other features of the present inventive concept will become more apparent by describing in detail exemplary embodiments thereof with reference to the accompanying drawings of which.

Figure 1:
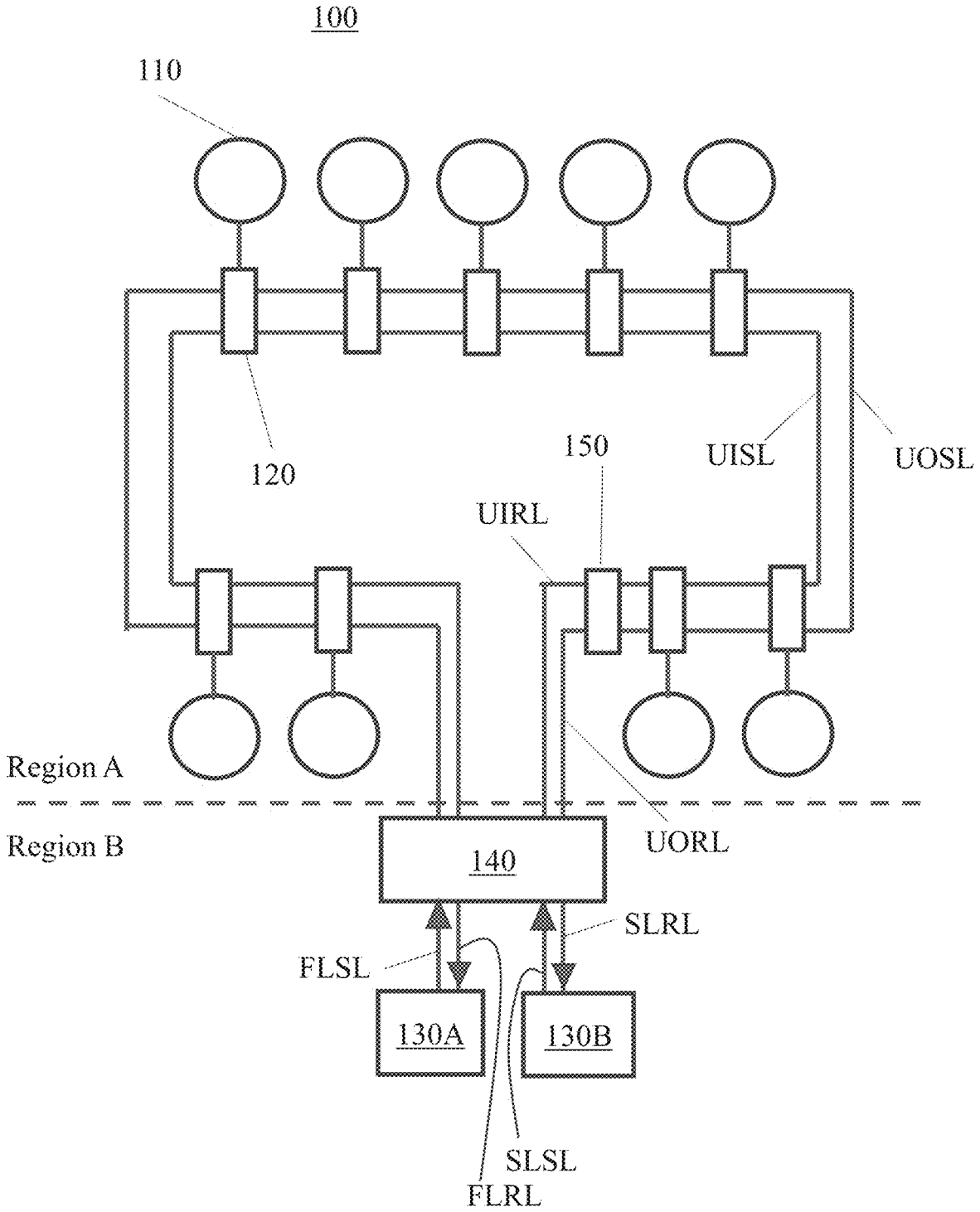
FIG. 1 shows a chemical-mechanical-polishing (CMP) system performing a planarization process on a wafer according to an exemplary embodiment.

It will be appreciated that for simplicity and clarity of illustration, elements illustrated in the drawings have not necessarily been drawn to scale unless described otherwise. For example, the dimensions of some of the elements are exaggerated relative to other elements for clarity. Further, where considered appropriate, reference numerals have been repeated among the drawings to indicate corresponding or analogous elements.

DETAILED DESCRIPTION OF EXEMPLARY EMBODIMENTS

Exemplary embodiments of the present inventive concept will be described below in detail with reference to the accompanying drawings. However, the inventive concept may be embodied in different forms and should not be construed as limited to the embodiments set forth herein.

FIG. 1 shows a chemical-mechanical-polishing (CMP) system 100 performing a planarization process on a wafer using a slurry distribution system according to an exemplary embodiment.

The CMP system 100 includes a plurality of CMP stations 110 and a slurry distribution system including a plurality of valve manifold boxes 120, a plurality of slurry supply units including a first slurry supply unit 130A and a second slurry supply unit 130B, a redundancy box 140, and a pressure transmitter box 150. The slurry distribution system of the CMP system 100 further includes at least two loops including an inner loop and an outer loop to supply slurry from the slurry supply units and return the slurry to the slurry supply units.

The CMP stations 110 each receives slurry from at least one of the inner loop and the outer loop through one of the valve manifold boxes 120 and performs a planarization process on a wafer using the slurry supplied through one of the valve manifold boxes 120.

The inner loop includes an upper inner supply line UISL supplying slurry from the redundancy box 140 to the CMP stations 110 and an upper inner return line UIRL returning the slurry not consumed by the CMP stations 110 to the redundancy box 140. The outer loop includes an upper outer supply line UOSL supplying slurry from the redundancy box 140 to the CMP stations 110 and an upper outer return line UORL returning the slurry not consumed by the CMP stations 110 to the redundancy box 140. In an exemplary embodiment, the CMP stations 110 may receive slurry from at least one of the upper inner supply line UISL and the upper outer supply line UOSL according to the operation of the valve manifold boxes 120. The valve manifold boxes 120 may circulate the slurry along the inner loop and the outer loop, supplying the slurry from either the inner loop or the outer loop to one of the CMP stations 110.

The redundancy box 140 receives slurry from at least one of the first slurry supply unit 130A and the second slurry supply unit 130B. In an exemplary embodiment, the first slurry supply unit 130A and the second slurry supply unit 130B may have the same configuration. For example, each of the first slurry supply unit 130A and the second slurry supply unit 130B may include a slurry supply drum for slurry, a blender where the slurry is mixed and diluted with deionized water and a chemical(s) such as $H_2O_2$ (hydrogen peroxide) and a pump. The pump may receive the mixed, diluted slurry and supply the slurry to the inner loop and the outer loop. The blender may receive slurry from the slurry supply drum. The blender may also receive the slurry that is not consumed in the CMP stations 110. Unless defined otherwise, the mixed, diluted slurry may be referred to as slurry throughout the specification.

The first slurry supply unit 130A may supply an outbound slurry to the redundancy box 140 through a first lower supply line FLSL and receive an inbound slurry from the redundancy box 140 through a first lower return line FLRL. The outbound slurry of the first slurry supply unit 130A may circulate at least one of the inner loop and the outer loop in a clockwise direction, returning to the first slurry supply unit 130A through the first lower return line FLRL. The second slurry supply unit 130B may supply an outbound slurry to the redundancy box 140 through a second lower supply line SLSL and receive an inbound slurry from the redundancy box 140 through the second lower return line SLRL. The outbound slurry of the second slurry supply unit 130B may circulate at least one of the inner loop and the outer loop in the clockwise direction, returning to the second slurry supply unit 130B through the second lower return line SLRL.

For example, when the first slurry supply unit 130A and the second slurry supply unit 130B are working, the first slurry supply unit 130A may supply an outbound slurry to the upper inner supply line UISL of the inner loop through the first lower supply line FLSL and the redundancy box 140; and the second slurry supply unit 130B may supply an outbound slurry to the upper outer supply line UOSL of the outer loop through the second lower supply line SLSL and the redundancy box 140.

The present inventive concept is not limited thereto. For example, the first slurry supply unit 130A may supply slurry to the outer loop, and the second slurry supply unit 130B may supply slurry to the inner loop. For the convenience of description, it is assumed that the first slurry supply unit 130A supplies slurry to the inner loop, and the second slurry supply unit 130B supplies slurry to the outer loop.

When one of the first slurry supply unit 130A and the second slurry supply unit 130B fails to provide slurry, the redundancy box 140 may supply an outbound slurry from a working slurry unit to both the inner loop and the outer loop.

For example, when the second slurry supply unit 130B fails to provide slurry to the outer loop, the redundancy box 140 may enable the first slurry supply unit 130A to supply an outbound slurry to both the inner loop and the outer loop. In this case, the outbound slurry from the first slurry supply unit 130A may circulate both the inner loop and the outer loop in the clockwise direction using the redundancy box 140.

As another example, when the first slurry supply unit 130A fails to provide slurry to the inner loop, the redundancy box 140 may enable the second slurry supply unit 130B to supply an outbound slurry to both the inner loop and the outer loop. In this case, the outbound slurry from the second slurry supply unit 130B may circulate both the inner loop and the outer loop in the clockwise direction using the redundancy box 140.

In an exemplary embodiment, the redundancy box 140 may have channels in a crisscross pattern to eliminate deadlegs in the channels so that an outbound slurry from at least one of the first slurry supply unit 130A and the second slurry supply unit 130B is supplied to both the inner loop and the outer loop without accumulation or solidification of slurry.

The configuration and operation of the redundancy box 140 will be described in detail with reference to FIG. 2.

The pressure transmitter box 150 may measure a point of use pressure of slurry flowing through the inner loop and the outer loop and feedback the measured pressure to the slurry supply units 130A and 130B so that a constant point of use pressure can be maintained.

The lines between the pressure transmitter box 150 and the redundancy box 140 may be referred to as an upper inner return line UIRL and an upper outer return line UORL. In this case, the inner loop further includes the upper inner return line UIRL, and the outer loop further includes the upper outer return line UORL.

In an exemplary embodiment, the CMP stations 110 may be located in a region A of a clean room while the redundancy box 140 and the first and second slurry supply units 130A and 130B may be located in a region B of a slurry room other than the clean room.

Figure 2:
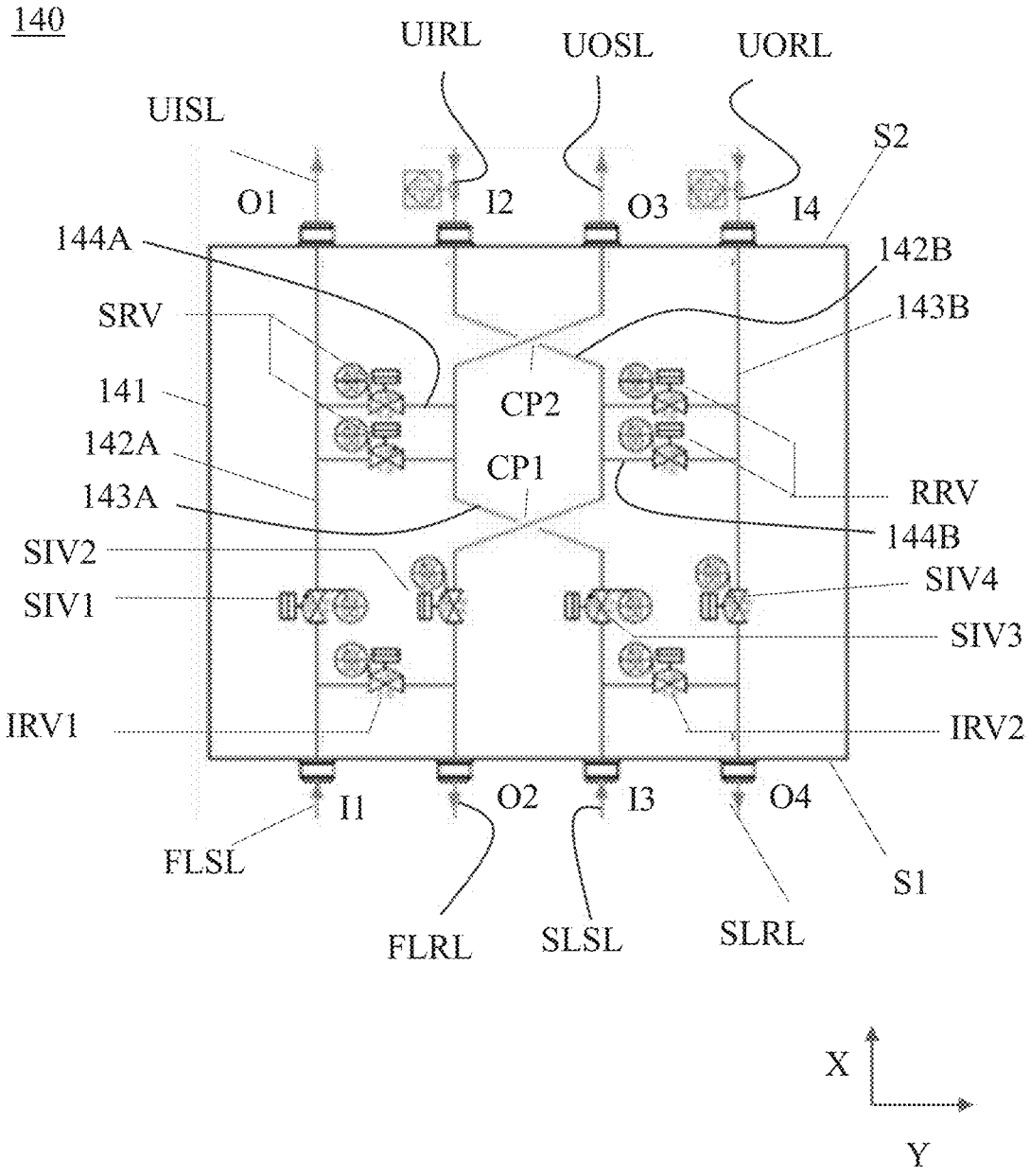
FIG. 2 shows a block diagram of a redundancy box according to an exemplary embodiment.

FIG. 2 shows a block diagram of a redundancy box 140 according to an exemplary embodiment.

The redundancy box 140 includes a housing 141 having a first side S1 and a second side S2, and a plurality of channels extending through the housing from the first side S1 to the second side S2 along a first direction X.

The channels include a first channel 142A connecting a first inlet I1 on the first side S1 and a first outlet O1 on the second side S2, a second channel 142B connecting a second outlet O2 on the first side S1 and a second inlet I2 on the second side S2, a third channel 143A connecting a third inlet I3 on the first side S1 and a third outlet O3 on the second side S2, and a fourth channel 143B connecting a fourth outlet O4 on the first side S1 and a fourth inlet I4 on the second side S2. An intermediate portion of the second channel 142B crisscrosses an intermediate portion of the third channel 143A in a second direction Y crossing the first direction X.

In an exemplary embodiment, the first channel 142A and the fourth channel 143B extend in a straight line along the first direction X. The second channel 142B and the third channel 143A that cross each other in a crisscross pattern are disposed between the first channel 142A and the fourth channel 143B.

In an exemplary embodiment, the redundancy box 140 includes the first channel 142A having a first system isolation valve SIV1, the second channel 142B having a second system isolation valve SIV2, the third channel 143A having a third system isolation valve SIV3 and the fourth channel 143B having a fourth system isolation valve SIV4.

The first channel 142A may connect selectively the first slurry supply unit 130A to the upper inner supply line UISL of the inner loop using the first system isolation valve SIV1. For example, to supply an outbound slurry from the first slurry supply unit 130A to the upper inner supply line UISL, the first system isolation valve SIV1 stays open so that slurry is allowed to pass from the first slurry supply unit 130A to the upper inner supply line UISL; and to block the first slurry supply unit 130A from supplying an outbound slurry to the upper inner supply line UISL for maintenance purpose, or when the first slurry supply unit 130A fails, the first system isolation valve SIV1 stays closed so that slurry cannot pass from the first slurry supply unit 130A to the upper inner supply line UISL.

The second channel 142B may connect selectively the upper inner return line UIRL of the inner loop to the first slurry supply unit 130A using the second system isolation valve SIV2. For example, to supply an inbound slurry from the upper inner return line UIRL to the first slurry supply unit 130A, the second system isolation valve SIV2 stays open so that slurry is allowed to pass from the upper inner return line UIRL to the first slurry supply unit 130A; and to block the first slurry supply unit 130A from receiving an inbound slurry from the upper inner return line UIRL for maintenance purpose, or when the first slurry supply unit 130A fails, the second system isolation valve SIV2 stays closed so that slurry cannot pass from the upper inner return line UIRL to the first slurry supply unit 130A.

The third channel 143A may connect selectively the second slurry supply unit 130B to the upper outer supply line UOSL of the outer loop using the third system isolation valve SIV3. For example, to supply an outbound slurry from the second slurry supply unit 130B to the upper outer supply line UOSL, the third system isolation valve SIV3 stays open so that slurry is allowed to pass from the second slurry supply unit 130B to the upper outer supply line UOSL; and to block the second slurry supply unit 130B from supplying an outbound slurry to the upper outer supply line UOSL for maintenance purpose, or when the second slurry supply unit 130B fails, the third system isolation valve SIV3 stays closed so that slurry cannot pass from the second slurry supply unit 130B to the upper outer supply line UOSL.

The fourth channel 143B may connect selectively the upper outer return line UORL of the outer loop to the second slurry supply unit 130B using the fourth system isolation valve SIV4. For example, to supply an inbound slurry from the upper outer return line UORL to the second slurry supply unit 130B, the fourth system isolation valve SIV4 stays open so that slurry is allowed to pass from the upper outer return line UORL to the second slurry supply unit 130B; and to block the second slurry supply unit 130B from receiving an inbound slurry from the upper outer return line UORL for maintenance purpose, or when the second slurry supply unit 130B fails, the fourth system isolation valve SIV4 stays closed so that slurry cannot pass from the upper outer return line UORL to the second slurry supply unit 130B.

The first lower supply line FLSL extends in the first direction X, connecting the first slurry supply unit 130A to the first inlet I1 of the redundancy box 140.

The first lower return line FLRL extends in the first direction X, connecting the first slurry supply unit 130A to the second outlet O2 of the redundancy box 140.

The second lower supply line SLSL extends in the first direction X, connecting the second slurry supply unit 130B to the third inlet I3 of the redundancy box 140.

The second lower return line SLRL extends in the first direction X, connecting the second slurry supply unit 130B to the fourth outlet O4 of the redundancy box 140.

The upper inner supply line UISL is connected to the first outlet O1 of the redundancy box 140; the upper inner return line UIRL is connected to the second inlet I2 of the redundancy box 140; the upper outer supply line UOSL is connected to the third outlet O3 of the redundancy box 140; and the upper outer return line UORL is connected to the fourth inlet I4 of the redundancy box 140.

The first inlet I1, the second outlet O2, the third inlet I3, and the fourth outlet O4 are arranged on the first side S1 in that order along the second direction Y. The first outlet O1, the second inlet I2, the third outlet O3, and the fourth inlet I4 are arranged on the second side S2 in that order along the second direction Y.

The redundancy box 140 further includes a first branch line 144A having a supply redundancy valve SRV and a second branch line 144B having a return redundancy valve RRV.

The first branch line 144A may connect selectively the first channel 142A and an intermediate portion of the third channel 143A to each other using the supply redundancy valve SRV. For example, when the first slurry supply unit 130A and the second slurry supply unit 130B are operating to supply slurry to the inner loop and the outer loop, respectively, the supply redundancy valve SRV stays closed, with the first system isolation valve SIV1 and the second system isolation valve SIV2 staying open; and when one of the first slurry supply unit 130A and the second slurry supply unit 130B fails and the other supplies slurry to the inner loop and the outer loop, the supply redundancy valve SRV stays open so that a working slurry supply unit supplies an outbound slurry to both the inner loop through the first channel 142A and the outer loop through the third channel 143A. In this case, the first channel 142A and the third channel 143A are connected to each other through the first branch line 144A. When the working slurry supply unit is the first slurry supply unit 130A and the second slurry supply unit 130B is non-functional, the first slurry supply unit 130A supplies the outbound slurry to both the inner loop and the outer loop, with the first system isolation valve SIV1 staying open and the third system isolation valve SIV3 staying closed. When the working slurry supply unit is the second slurry supply unit 130B and the first slurry supply unit 130A is non-functional, the second slurry supply unit 130B supplies the outbound slurry to both the inner loop and the outer loop, with the first system isolation valve SIV1 staying closed and the third system isolation valve SIV3 staying open.

In an exemplary embodiment, the first branch line 144A may include a plurality of branch lines and a plurality of supply redundancy valves. The supply redundancy valves may be controlled in the same manner. For example, the supply redundancy valves all may stay open or closed. For the convenience of description, the first branch line 144A has two branch lines and two supply redundancy valves.

The first branch line 144A may be extended in the second direction Y.

The second branch line 144B may connect selectively the fourth channel 143B and an intermediate portion of the second channel 142B to each other using the return redundancy valve RRV. For example, when the first slurry supply unit 130A and the second slurry supply unit 130B are operating to receive slurry from the inner loop and the outer loop, respectively, the return redundancy valve RRV stays closed, with the third system isolation valve SIV3 and the fourth system isolation valve SIV4 staying open; and when one of the first slurry supply unit 130A and the second slurry supply unit 130B fails and the other supplies slurry, the return redundancy valve RRV stays open so that a working slurry supply unit receives an inbound slurry from both the inner loop through the second channel 142B and the outer loop through the fourth channel 143B. In this case, the second channel 142B and the fourth channel 143B are connected to each other through the second branch line 144B. When the working slurry supply unit is the first slurry supply unit 130A and the second slurry supply unit 130B is non-functional, the first slurry supply unit 130A receives the inbound slurry, with the second system isolation valve SIV2 staying open and the fourth system isolation valve SIV4 staying closed. When the working slurry supply unit is the second slurry supply unit 130B and the first slurry supply unit 130A is non-functional, the second slurry supply unit 130B receives the inbound slurry, with the second system isolation valve SIV2 staying closed and the fourth system isolation valve SIV4 staying open.

In an exemplary embodiment, the second branch line 144B may include a plurality of branch lines and a plurality of return redundancy valves. The return redundancy valves may be controlled in the same manner. For example, the return redundancy valves all may stay open or closed. For the convenience of description, the second branch line 144B has two branch lines and two return redundancy valves.

The second branch line 144B may be extended in the second direction Y.

In an exemplary embodiment, the second channel 142B crisscrosses the third channel 143A, with the second channel 142B and the third channel 143A each extending in the first direction X. For example, the second channel 142B and the third channel 143A cross each other at a first cross-point CP1 and cross each other back via a second cross-point CP2. Note that the second channel 142B and the third channel 143A are not connected to each other at the cross-points CP1 and CP2. For example, the second channel 142B and the third channel 143A may cross each other at the cross-points CP1 and CP2 by overlapping each other along a direction orthogonal to the XY plane. The intermediate portion of the third channel 143A may include a portion of the third channel 143A from the first cross-point CP1 to the second cross-point CP2. The intermediate portion of the second channel 142B may include a portion of the second channel 142B from the first cross-point CP1 to the second cross-point CP2.

The first branch line 144A connects the intermediate portion of the third channel 143A to the first channel 142A, and the second branch line 144B connects the intermediate portion of the second channel 142B to the fourth channel 143B. For example, the first branch line 144A is disposed at a shortest distance between the first channel 142A and the third channel 143A, connecting the first channel 142A to the intermediate portion of the third channel 143A. For example, the second branch line 144B is disposed at a shortest distance between the fourth channel 143B and the second channel 142B, connecting the fourth channel 143B to the intermediate portion of the second channel 142B.

In an exemplary embodiment, a shortest distance between the intermediate portion of the second channel 142B and the fourth channel 143B is less than a shortest distance between the intermediate portion of the third channel 143A and the fourth channel 143B.

In an exemplary embodiment, a shortest distance between the intermediate portion of the third channel 143A and the first channel 142A is less than a shortest distance between the intermediate portion of the second channel 142B and the first channel 142A.

The supply redundancy valve SRV may also be referred to as a first valve. The return redundancy valve RRV may also be referred to as a second valve.

The first internal recirculation valve IRV1 may allow or block slurry flow between the first channel 142A and the second channel 142B. For example, if the first slurry supply unit 130A is working, the first internal recirculation valve IRV1 stays closed to block slurry flow between the first channel 142A and the second channel 142B. If the first slurry supply unit 130A shuts down and the second slurry supply unit 130B remains running, the second slurry supply unit 130B may serve as a redundant system for providing slurry supply to the first channel 142A and the second channel 142B. In this case, the first internal recirculation valve IRV1 stays open to allow slurry flow between the first channel 142A and the second channel 142B, while the system isolation valves SIV1 and SIV2 stay closed, thereby completing an internal recirculation of slurry flow between the supply pump of the first slurry supply unit 130A, the first channel 142A and the second channel 142B. Furthermore, the internal recirculation mechanism prevents deadheading of the supply pump of the first slurry supply unit 130A and stagnation of slurry within the piping of this unit, while maintaining supply pump speed to mitigate pressure fluctuation during redundancy removal (closure of the first internal recirculation valve IRV1 and the reestablishment of the original slurry flow path by the first slurry supply unit 130A via channels 142A and 142B once the system isolation valves SIV1 and SIV2 reopen, respectively).

The second internal recirculation valve IRV2 may allow or block slurry flow between the third channel 143A and the fourth channel 143B. For example, if the second slurry supply unit 130B is working, the second internal recirculation valve IRV2 stays closed to block slurry flow between the third channel 143A and the fourth channel 143B. If the second slurry supply unit 130B shuts down and the first slurry supply unit 130A remains running, the first slurry supply unit 130A may serve as a redundant system for providing slurry supply to the third channel 143A and the fourth channel 143B. In this case, the second internal recirculation valve IRV2 stays open to allow slurry flow between the third channel 143A and the fourth channel 143B, while the system isolation valves SIV3 and SIV4 stay closed, thereby completing an internal recirculation of slurry flow between the supply pump of the second slurry supply unit 130B, the third channel 143A and the fourth channel 143B. Furthermore, the internal recirculation mechanism prevents deadheading of the supply pump of the second slurry supply unit 130B and stagnation of slurry within the piping of this unit, while maintaining supply pump speed to mitigate pressure fluctuation during redundancy removal (closure of the second internal recirculation valve IRV2 and the reestablishment of the original slurry flow path by the second slurry supply unit 130B via channels 143A and 143B once the system isolation valves SIV3 and SIV4 reopen, respectively).

The first internal recirculation valve IRV1 may also be referred to as a third valve, and the second internal recirculation valve IRV2 may also be referred to as a fourth valve.

While the present inventive concept has been shown and described with reference to exemplary embodiments thereof, it will be apparent to those of ordinary skill in the art that various changes in form and detail may be made therein without departing from the spirit and scope of the inventive concept as defined by the following claims.

What is claimed is:

1. An apparatus of supplying slurry for a planarization process, the apparatus comprising:

a housing having a first side and a second side; and a plurality of channels extending through the housing from the first side to the second side along a first direction, the channels including:

a first channel connecting a first inlet on the first side and a first outlet on the second side, a second channel connecting a second outlet on the first side and a second inlet on the second side, a third channel connecting a third inlet on the first side and a third outlet on the second side, and a fourth channel connecting a fourth outlet on the first side and a fourth inlet on the second side, wherein an intermediate portion of the second channel crisscrosses an intermediate portion of the third channel along a second direction crossing the first direction.

2. The apparatus of claim 1, wherein:

a shortest distance between the intermediate portion of the second channel and the fourth channel is less than a shortest distance between the intermediate portion of the third channel and the fourth channel, and a shortest distance between the intermediate portion of the third channel and the first channel is less than a shortest distance between the intermediate portion of the second channel and the first channel.

3. The apparatus of claim 1, wherein:

a first valve connects the first channel to the intermediate portion of the third channel, and a second valve connects the fourth channel to the intermediate portion of the second channel.

4. The apparatus of claim 1, wherein:

a third valve connects the first channel to the second channel, and a fourth valve connects the third channel to the fourth channel.

5. The apparatus of claim 1, wherein:

the first inlet, the second outlet, the third inlet, and the fourth outlet are arranged on the first side in that order along the second direction; and the first outlet, the second inlet, the third outlet, and the fourth inlet are arranged on the second side in that order along the second direction.

6. An apparatus of supplying slurry for a planarization process, the apparatus, comprising:

a housing having a first side and a second side; and a first channel connecting a first inlet on the first side and a first outlet on the second side;

a second channel connecting a second outlet on the first side and a second inlet on the second side;

a third channel connecting a third inlet on the first side and a third outlet on the second side;

a fourth channel connecting a fourth outlet on the first side and a fourth inlet on the second side;

a first branch line selectively connecting the first channel and the third channel using a first valve; and a second branch line selectively connecting the second channel and the fourth channel using a second valve, wherein the second channel and the third channel extend in a first direction, crossing each other at a first cross-point and crossing each other back via a second cross-point, and wherein the first branch line and the second branch line each extends in a second direction crossing the first direction.

7. The apparatus of claim 6, wherein the first branch line is disposed at a shortest distance between the first channel and an intermediate portion of the third channel, and wherein the second branch line is disposed at a shortest distance between an intermediate portion of the second channel and the fourth channel.

8. The apparatus of claim 7, wherein the intermediate portion of the third channel is a portion of the third channel between the first cross-point and the second cross-point, and wherein the intermediate portion of the second channel is a portion of the second channel between the first cross-point and the second cross-point.

9. The apparatus of claim 8, wherein:

a shortest distance between the intermediate portion of the second channel and the fourth channel is less than a shortest distance between the intermediate portion of the third channel and the fourth channel, and a shortest distance between the intermediate portion of the third channel and the first channel is less than a shortest distance between the intermediate portion of the second channel and the first channel.

10. The apparatus of claim 6, wherein the first channel and the fourth channel extend in a straight line along the first direction.

11. The apparatus of claim 10, wherein the second channel and the third channel are disposed between the first channel and the fourth channel.

12. The apparatus of claim 6, wherein:

a third valve connects the first channel to the second channel, and a fourth valve connects the third channel to the fourth channel.

13. The apparatus of claim 6, wherein:

the first inlet, the second outlet, the third inlet, and the fourth outlet are arranged on the first side in that order along the second direction; and the first outlet, the second inlet, the third outlet, and the fourth inlet are arranged on the second side in that order along the second direction.

14. A chemical-mechanical polishing (CMP) system, comprising:

a plurality of slurry supply units including a first slurry supply unit and a second slurry supply unit;

a redundancy box receiving slurry from at least one of the first slurry supply unit and the second slurry supply unit;

at least two loops including an inner loop and an outer loop; and a plurality of CMP stations each receiving the slurry from at least one of the inner loop and the outer loop and performing a planarization process on a wafer using the slurry, wherein the redundancy box includes:

a first channel connecting selectively the first slurry supply unit to a supply line of the inner loop, a second channel connecting selectively a return line of the inner loop to the first slurry supply unit, a third channel connecting selectively the second slurry supply unit to a supply line of the outer loop, a fourth channel connecting selectively a return line of the outer loop to the second slurry supply unit, a first branch line connecting selectively the first channel to an intermediate portion of the third channel, and a second branch line connecting selectively an intermediate portion of the second channel to the fourth channel, wherein the intermediate portion of the second channel crisscrosses the intermediate portion of the third channel.

15. The CMP system of claim 14, wherein the first channel includes a valve for selectively connecting the first slurry supply unit to the supply line of the inner loop, and wherein the second channel includes a valve for selectively connecting the return line of the inner loop to the first slurry supply unit.

16. The CMP system of claim 14, wherein the third channel includes a valve for connecting selectively the second slurry supply unit to the supply line of the outer loop, and wherein the fourth channel includes a valve for connecting selectively the return line of the outer loop to the second slurry supply unit.

17. The CMP system of claim 14, wherein the first branch line includes a valve for connecting selectively the first channel to the intermediate portion of the third channel, and wherein the second branch line includes a valve for connecting selectively the intermediate portion of the second channel to the fourth channel.

* * * * *